United States Patent [19]

Jang

[11] Patent Number: 4,844,254

[45] Date of Patent: Jul. 4, 1989

[54] CIGARETTE LIGHTER WITH ATTACHMENT DEVICE

[76] Inventor: Tzong-Shenq Jang, No. 313, 6-3 Fl., Chung-San Rd., Taichung, Taiwan

[21] Appl. No.: 252,153

[22] Filed: Oct. 3, 1988

[51] Int. Cl.[4] ..... A24F 15/18

[52] U.S. Cl. ..... 206/236; 206/85; 431/253; 431/343

[58] Field of Search ..... 206/38, 85–89, 206/235, 236; 431/154–156, 249, 253, 277, 287, 298, 343, 345, 356

[56] References Cited

U.S. PATENT DOCUMENTS

| | | | |
|---|---|---|---|
| 2,572,863 | 10/1951 | Jaap | 431/253 |
| 3,069,886 | 12/1962 | Coats | 431/343 |
| 3,178,016 | 4/1965 | Coats | 206/87 |
| 4,223,687 | 9/1980 | Sandeen | 431/253 |
| 4,223,784 | 9/1980 | Kaneyasu | 431/343 |
| 4,363,432 | 12/1982 | Warthen | 206/87 |
| 4,457,697 | 7/1984 | Kitabayashi | 431/277 |
| 4,750,613 | 6/1988 | Kopp | 206/87 |

*Primary Examiner*—Jimmy G. Foster

*Attorney, Agent, or Firm*—Charles H. Lindrooth

[57] ABSTRACT

The present invention provides a cigarette lighter case whose one edge is connected with a one piece clip member by which the lighter can be attached to a cigarette package. The clip member has at least three parallelly spaced planar plates lying in the same plane and a transverse strip coplanar with and connected to one end of each of said plates. The clip member is connected to the lighter case by means of a hinge member.

8 Claims, 7 Drawing Sheets

CIGARETTE LIGHTER WITH ATTACHMENT DEVICE

BACKGROUND OF THE INVENTION

This invention relates to a cigarette lighter, and particularly to a cigarette lighter with an attachment device by which the cigarette lighter can be easily connected to a cigarette package.

An object of the invention is to provide a cigarette lighter which can be easily attached to or detached from a cigarette package so that the user may have a cigarette package which is always accompanied by a cigarette lighter and will no longer be inconvenienced by the loss or inavailability of a cigaretter lighter.

SUMMARY OF THE PRESENT INVENTION

The present invention provides a cigarette lighter case whose one edge is connected with a one piece clip member by which the lighter can be attached to a cigarette package. The clip member has at least three parallelly spaced planar plates lying in the same plane and a transverse strip coplanar with and connected to one end of each of said plates. The clip member is connected to the lighter case by means of a hinge member.

The presently preferred embodiment will be described in detail with reference to the accompanying drawings, in which:

DETAILED DESCRIPTION OF THE PREFERRED EMBODIMENT

Figure 1:
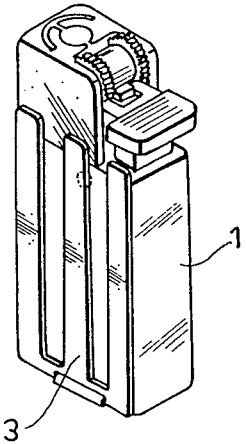
FIG. 1 is a perspective view of a first embodiment of a cigarette lighter according to the present invention.
Figure 2:
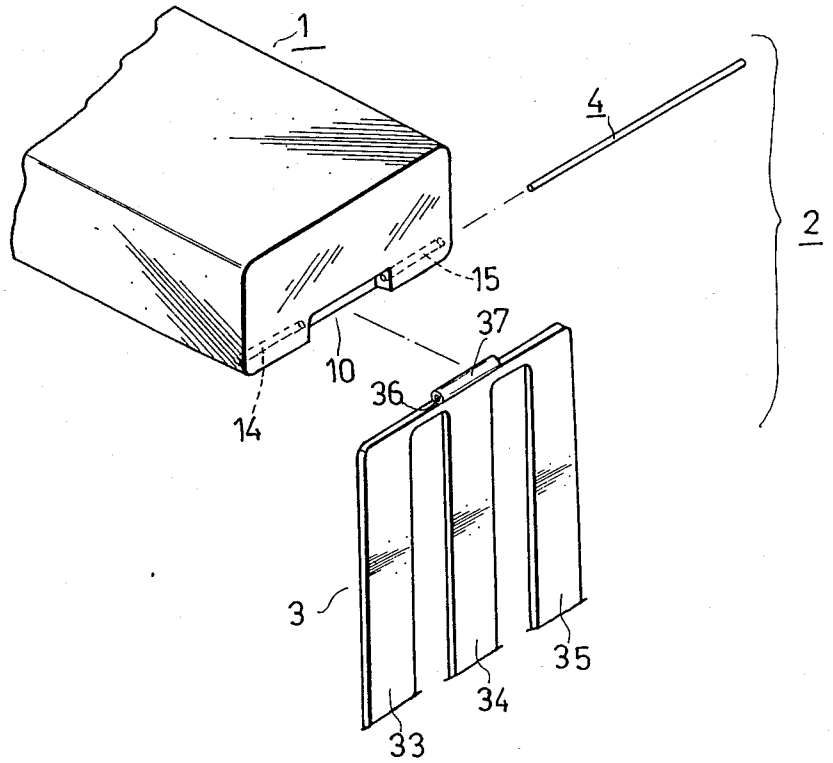
FIG. 2 is an exploded view of the cigarette lighter of FIG. 1.

Referring to FIGS. 1 and 2, a preferred embodiment of the present invention includes a cigarette lighter 1 which incorporates an attachment device 2. The attachment device 2 includes a clip member 3 which has three parallelly spaced plates 33, 34 and 35 lying in the same plane and connected to each other at one sidegs thereof with a transverse strip 36 which is coplanar with the parallel plates. A sleeve member 37 is integrally formed with the strip 36.

One edge of the cigarette lighter 1 is provided with a recess 10 adapted to receive the sleeve member 37. A pin 4 is inserted into two aligned bores 14 and 15 of the lighter 1 and the sleeve member 37, thereby hinging the clip member 3 to the casing of the cigarette lighter 1.

Figure 3:
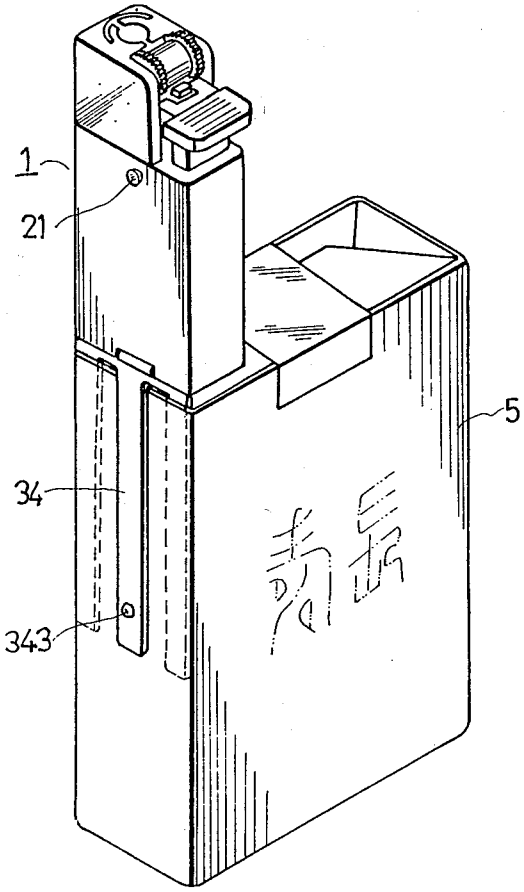
FIGS. 3, 4 and 5 show that the lighter is attached to a cigarette package in different positions.
Figure 4:
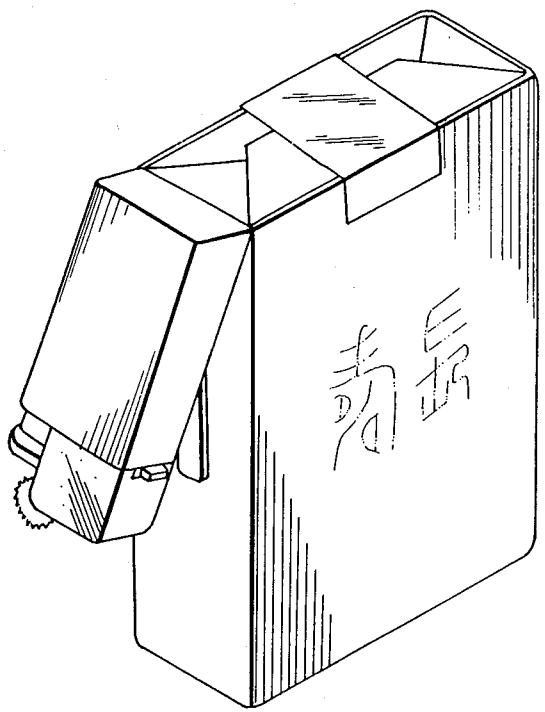
Figure 5:
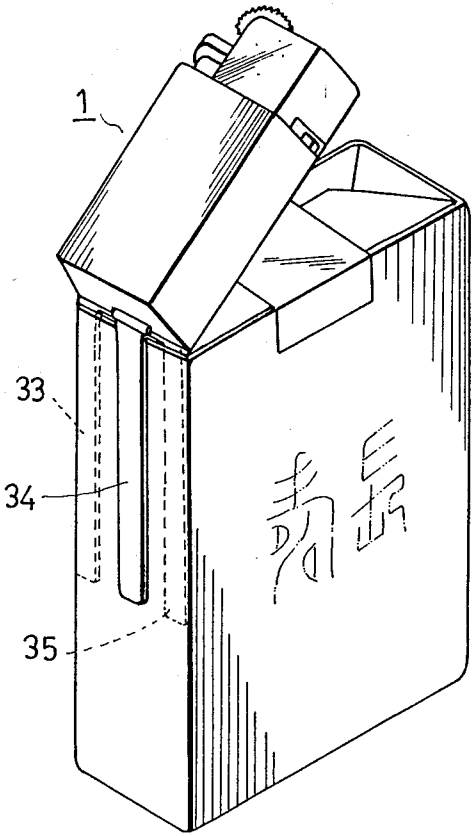

With the attachment device 2, the cigarette lighter 1 can be attached detachably to a cigarette package 5 as shown in FIGS. 3, 4 and 5, wherein the plates 33 and 35 of the clip member 3 are inserted into a clearance between one side of the outer package of the cigarettes and the inner aluminum foil provided in the outer package. The intermediate plate 34 is placed outside the cigarette package, thereby clamping one side of the cigarette package. Preferably, an additional securing means which includes an engaging recess 21 and an engaging stud 343 is provided on the cigarette package and the intermediate plate 34 as shown in FIG. 3. The recess 21 can engage with the stud 43 when the lighter 1 is turned downward.

Figure 6:
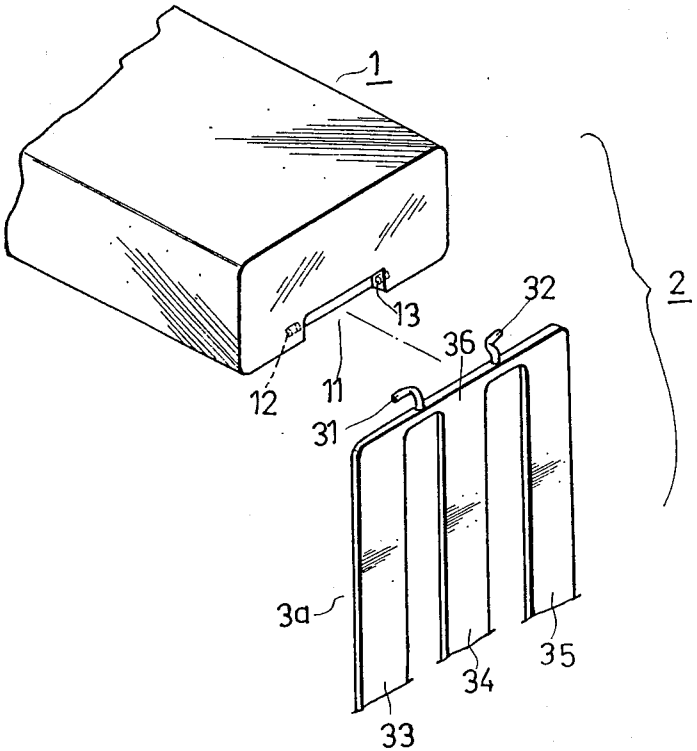
FIG. 6 is an exploded view of a second embodiment of the present invention.

FIG. 6 shows a clip member **3*a* of the second embodiment which is different from the clip member 3 in that the strip 36 is provided with two outwardly extending hooks 31 and 32 which are inserted into two opposite holes 12 and 13 of the cigarette lighter 1**.

Figure 7:
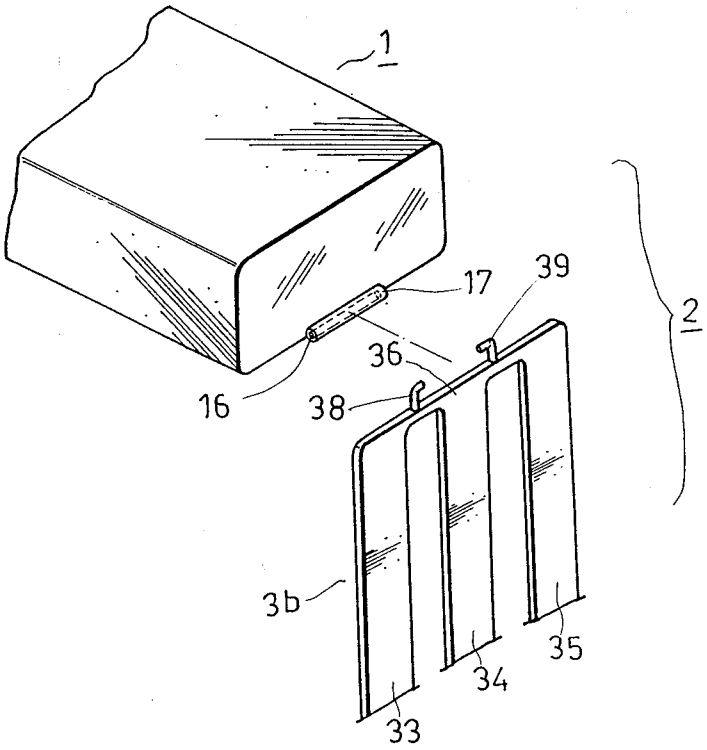
FIG. 7 is an exploded view of a third embodiment of the present invention.

FIG. 7 shows a clip member **3*b* of the third embodiment which is different from the clip member 3 in that the strip 36 is provided with two inwardly extending hooks 38 and 39 inserted in a bore 16 of a sleeve member 17** which is formed integrally with the cigarette lighter.

Figure 8:
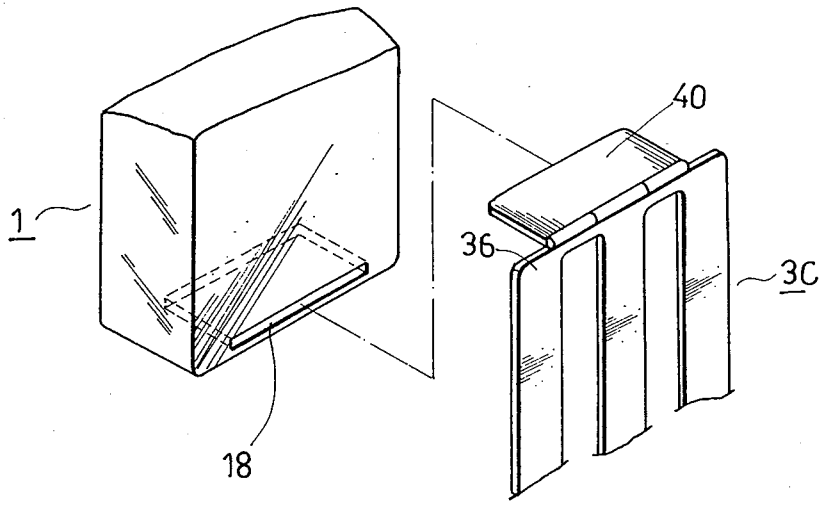
FIG. 8 is an exploded view of a fourth embodiment of the present invention.

FIG. 8 shows a clip member **3*c* of the fourth embodiment which includes a hinged plate 40 connected to the strip 36. The hinged plate 40 is inserted in a deep, narrow groove 18 of the cigarette lighter 1**.

Figure 9:
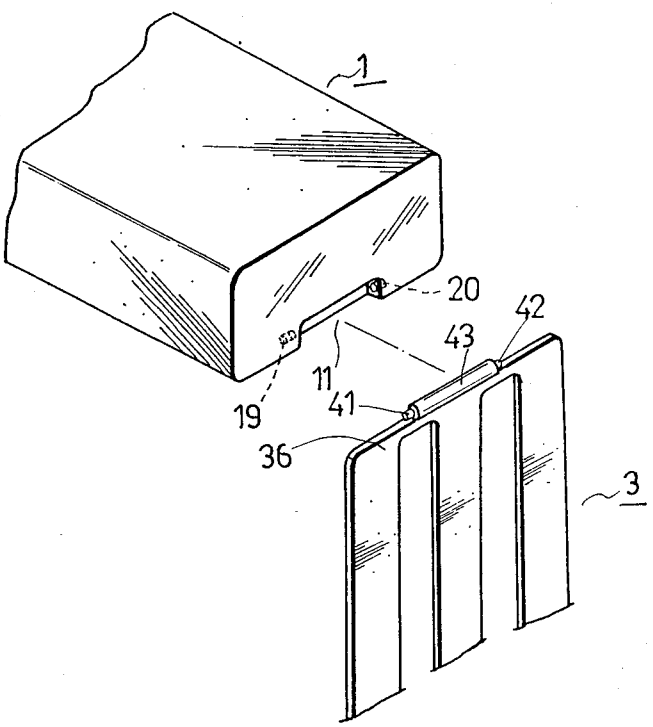
FIG. 9 is an exploded view of a fifth embodiment of the present invention.

FIG. 9 shows a clip member **3*d* of the fifth embodiment which includes a cylindrical lug member 43 having two opposite end pins 41 and 42 inserted in two recesses 19, 20 of the case of the cigarette lighter 1**.

With the invention thus explained, it is apparent that numerous modifications and variations can be made without departing from the scope of the invention. It is therefore intended that the invention be limited only as indicated in the appended claims.

What I claim is:

1. A cigarette lighter case comprising:

a case having one side with at least one edge;

a one piece clip member having at least three parallelly spaced planar plates lying in in the same plane and a transverse strip coplanar with and connected to one end of each of said plates; and means for hinging said clip member to said one edge of said case.

2. A cigarette lighter case as claimed in claim 1, wherein said case has a recessed surface and a bore means at said edge, and said hinging means includes an insert member to be inserted into said bore means.

3. A cigarette lighter case as claimed in claim 2, wherein said hinging means includes adjacent to said recessed surface, an insert member to be inserted into said bore means.

4. A cigarette lighter case as claimed in claim 2. wherein said hinging means includes two hook members extending from said strip member, said hook members having hooking ends extending oppositely and outwardly and inserted into said bore means.

5. A cigarette lighter case as claimed in claim 2, wherein said hinging means includes a cylindrical projection formed integrally with said strip, said cylindrical projection having at two ends thereof two opposite end pins which are inserted into said bore means.

6. A cigaretter lighter case as claimed in claim 1, wherein said edge of said case has a sleeve member formed integrally therewith, and said hinging means includes two hook members extending from said transverse strip and inserted into said sleeve member of said case.

7. A cigarette lighter case as claimed in claim 1, wherein said strip of said clip member has a plate hinged thereto, said hinged plate being inserted into said bore means.

8. A cigarette lighter case as claimed in claim 2, wherein said hinging means includes a sleeve member integrally formed with said strip member and an insert rod to be inserted into said sleeve and said bore means.

* * * * *